United States Patent [19]

Weinar et al.

[11] 4,055,930

[45] Nov. 1, 1977

[54] GRID CEILING TRIM

[75] Inventors: Roger Neil Weinar; John Anthony Eder, both of Tonawanda, N.Y.

[73] Assignee: Ceiling Resurfacing Systems, Inc., Eggertsville, N.Y.

[21] Appl. No.: 690,609

[22] Filed: May 27, 1976

[51] Int. Cl.[2] ..... E04C 2/38; E04B 1/00

[52] U.S. Cl. ..... 52/717; 52/98; 52/287; 52/463

[58] Field of Search ..... 52/98, 484, 716, 717, 52/718, 469, 242, 665, 727, 732, 720, 494, 495, 498, 461, 738, 287, 463

[56] References Cited

U.S. PATENT DOCUMENTS

| | | | |
|---|---|---|---|
| 1,910,160 | 5/1933 | Gorman | 52/665 |
| 2,318,092 | 5/1943 | Olsen | 52/484 |
| 2,389,171 | 11/1945 | Urbain | 52/484 |
| 2,942,703 | 6/1960 | Nelsson | 52/717 |
| 3,246,432 | 4/1966 | Young, Jr. | 52/98 |
| 3,486,311 | 12/1969 | Allan, Jr. | 52/484 |
| 3,594,972 | 7/1971 | Jones et al. | 52/716 |
| 3,785,110 | 1/1974 | Galloway et al. | 52/715 |
| 3,855,747 | 12/1974 | Langan | 52/506 |
| 3,936,990 | 2/1976 | Garrison | 52/717 |

*Primary Examiner*—Ernest R. Purser
*Assistant Examiner*—Robert C. Farber
*Attorney, Agent, or Firm*—Raymond F. Kramer

[57] ABSTRACT

A decorative trim strip and a suspended ceiling construction employing the trim strip with structural T- and L-beams having laterally extending portions or portion, wherein such trim strip is a resilient longitudinal "J" channel section having a lengthwise opening communicating with the interior thereof through which a laterally extending portion of a structural beam can be inserted internally to engage and maintain the decorative trim strip.

8 Claims, 8 Drawing Figures

GRID CEILING TRIM

BACKGROUND OF THE INVENTION

1. Field of the Invention

Exposed grid suspended ceiling constructions are extensively used in private and commercial building. Such constructions employ metal L-beam members, often called wall angles, fastened with nails or screws to the perimeter walls. Metal main T-beam members are then supported on wire hangers in predetermined fashion and transverse or cross T-beam members cooperatively interconnect in a determined manner to form a rigid grid system within the perimeter.

This metal grid network serves as a convenient support system for lay-in modules or panels, such as acoustical units, light fixtures and the like.

Maintenance on these exposed grid ceilings is accomplished by painting and/or replacing the lay-in acoustical panels. However, the exposed metal flanges accumulate a film of smoke, grease and dirt that results in poor paint adhesion unless expensive pre-treatment, such as washing or sanding is effected. Also, priming is necessary where rust occurs.

It is desirable therefore to have a decorative trim strip to mechanically resurface the exposed flanges of the dirty metal grid runners or beams.

Moreover, it is advantageous to have available an economical trim strip that may be installed with the panels and light fixtures in place and may be used on either L-beam members or T-beam members.

2. Description of the Prior Art

Grid ceiling covers have been disclosed in the prior art, and particularly in U.S. Pat. No's. 3,594,972 and 3,936,990. However, even though the structures disclosed in these patents have merit in the highly decorative and expensive new installation field, they do not lend themelves to the economical renovation of old ceilings, which is the primary object of this invention.

SUMMARY OF THE INVENTION

It is an object of the invention to provide a method of improving existing suspended ceiling constructions.

It is a further object of this invention to provide a decorative trim strip that may be used on either the structural L-beams or T-beams of an existing suspended ceiling construction.

It is yet another object of the invention to provide a decorative trim strip for use on existing suspended ceiling constructions wherein the trim strip can be easily positioned with the ceiling panels in place in the grid network.

Another object of the invention is to provide a decorative intersection cap for use with the decorative trim strip.

These and other objects of the invention attained by use of a longitudinally hollow "J" section having an opening running lengthwise of the hollow portion and communicating with the interior thereof, through which a single laterally extending flange portion of a structural grid beam can enter for subsequent positioning.

DESCRIPTION OF THE DRAWING

In the accompanying drawing.

DESCRIPTION OF THE PREFERRED EMBODIMENTS

Figure 1:
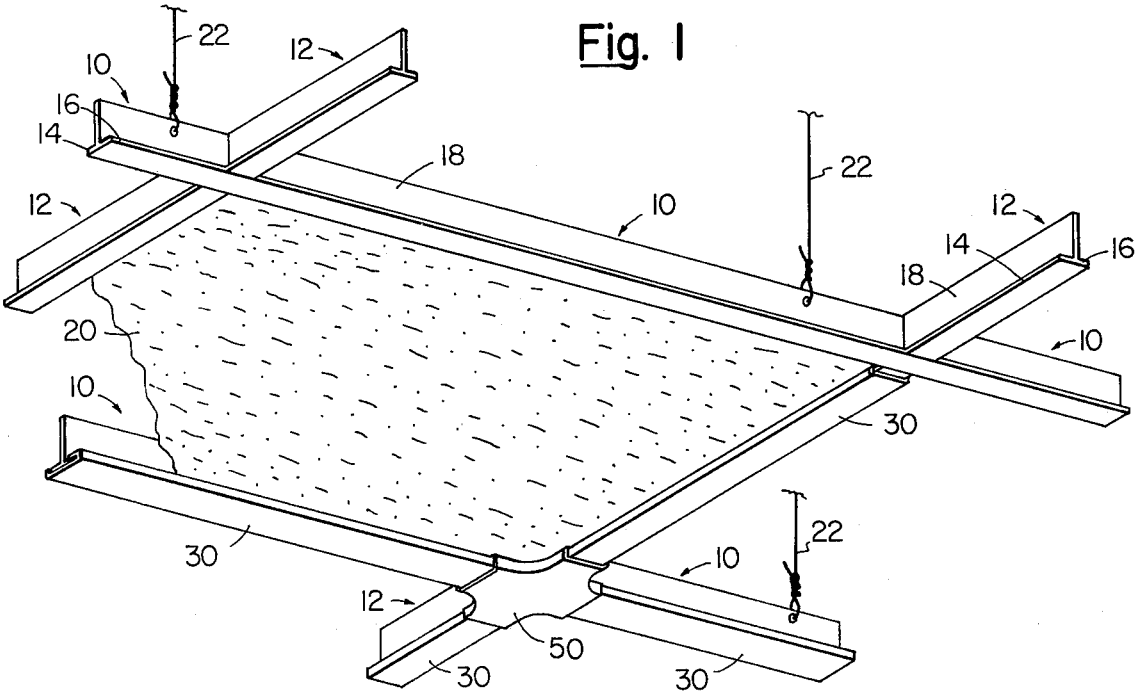
FIG. 1 is an isometric view looking upwardly that shows a portion of a suspended ceiling construction employing structural T-beam members using the decorative trim strips and a decorative intersection cap according to the present invention.

Referring now to FIG. 1, there is shown a suspended ceiling construction using trim strips and an intersection cap unit in accordance with the principles of this invention. The suspended ceiling construction includes a grid having rows of spaced apart parallel extending main structural T-beam members, generally denoted by 10 having flanges 14 and 16 extending laterally from a web 18 and further including spaced apart parallel extending crossing rows of usually shorter transverse structural T-beam members 12, having laterally extending portions like those of the structural main T-beam members 10.

The transverse structural T-beam members 12 extend between the main structural T-beam members 10 to intersect them at right angles thereto and at spaced intervals along the lengths of the main T-beam members 10. Appropriate support means, such as wires 22, support the grid from overlying joists and the like. The illustrated suspended ceiling construction further includes modules such as acoustical panels 20 of a glass or mineral fiber construction. Longitudinal hollow "J" members or trim strips 30 fit on laterally extending flange portions of the structural T-beam members 10 and 12 and are fashioned to run substantially along the lengths of the T-beam members between intersecting T-beam members, as indicated in FIG. 1.

Figure 2:
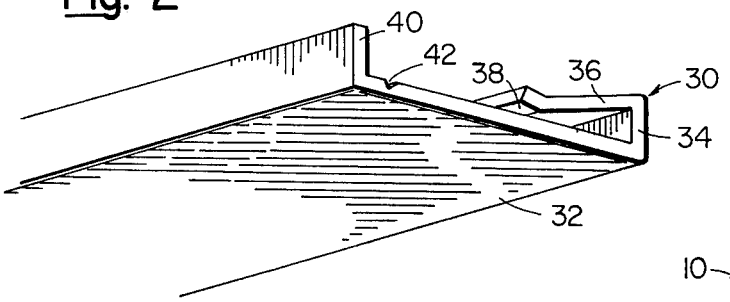
FIG. 2 is an enlarged isometric view of a portion of the decorative trim strip according to the invention as depicted in FIG. 1.

FIG. 2 illustrates an enlarged view of the decorative trim strip 30, generally shown in FIG. 1. The resilient trim strip 30 has a horizontal lower flange 32 substantially equal in width to the total width of both T-beam flanges but slightly wider, an upper horizontal flange 36 slightly less than half of the width of lower flange 32 and a short vertical web 34 extending between said horizontal flange portions and an opposing vertical web 40 forming a channel shaped "J" section including a longitudinal "V" shaped weakening trough extending the entire length of the lower flange 32.

Figure 3:
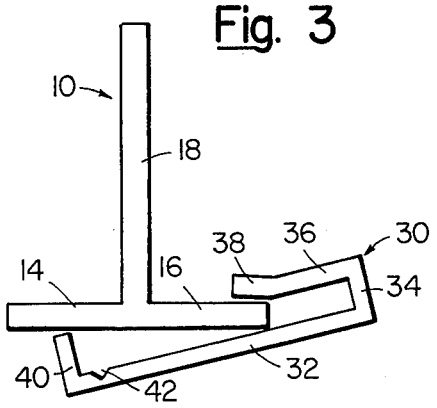
FIG. 3 is an end elevation exemplifying an initial step in positioning the trim strip illustrated in FIGS. 1 and 2 on the flange of a typical structure T-beam member.
Figure 4:
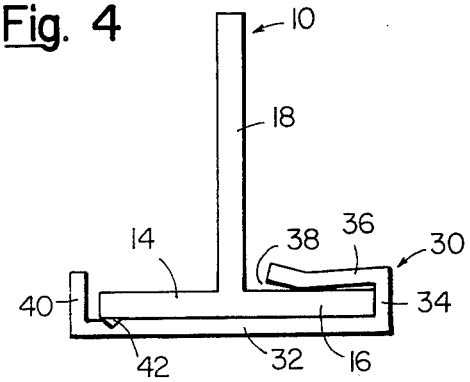
FIG. 4 is an end elevation illustrating the trim strip in supported and aligned position on the structural T-beam flange.

In practice the trim strip 30 is made by an extrusion process. While it has been useful to use polyvinyl chloride plastic to make a semi-rigid trim strip, other suitable materials may be employed. The simple cross-section of the trim strip lends itself to the metal roll forming process. FIGS. 3 and 4 illustrate steps for placing the trim strip 30 in position on a structural T-beam member 10. Initially trim strip 30 is moved so as to have the flange portion 16 of the T-beam 10 pass through the opening 38 created by the upwardly angled end of upper flange 36 and lower flange 32 along a path extending laterally. With such movement the trim strip 30 is placed in a temporary position laterally offset resiliently deflecting apart upper flange 36 and lower flange 32 to permit vertical web 40 to pass under flange portions 14 and 16 of structural T-beam member 10. FIG. 3 represents the trim strip 30 in this temporary position.

Vertical web 40 is more remote from vertical web 34 than the total flange width of any structural T-beam member 10 so lower horizontal flange 32 is permitted to return to rest against the flanges 14 and 16 of the structural T-beam 10, as illustrated in FIG. 4.

Figure 5:
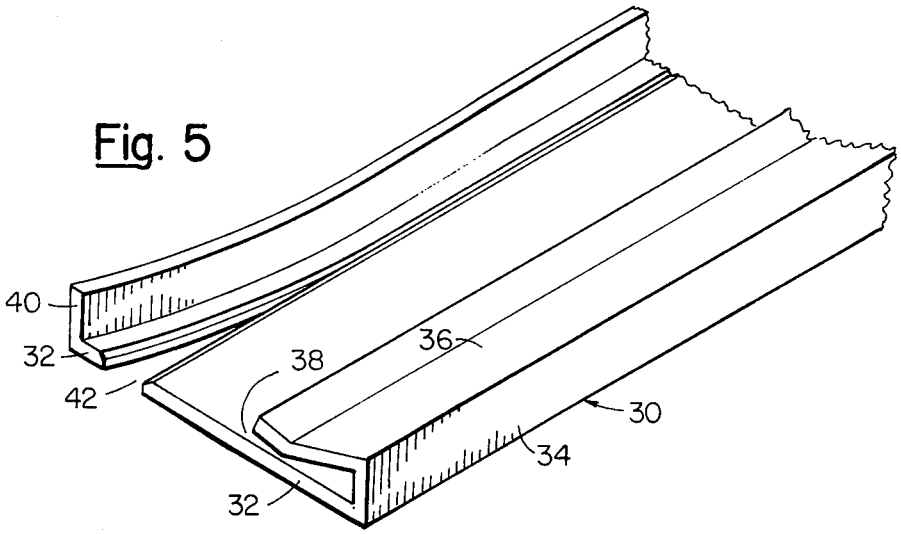
FIG. 5 is an enlarged isometric view of a portion of the trim strip illustrating the tear-away conversion of the trim strip for use on structural L-beam flanges.
Figure 6:
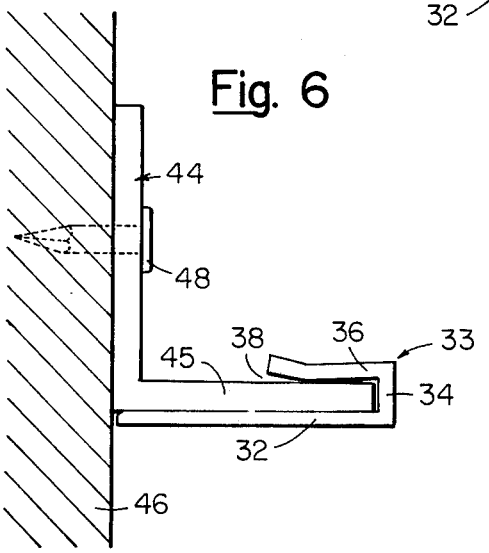
FIG. 6 is an end elevation of a modified trim strip according to the principles of the invention, supported and positioned on the structural L-beam flange, as used about the perimeter of a suspended ceiling construction.

FIG. 5 illustrates a conversion of the trim strip 30 for use on structural L-beam perimeter sections. Vertical web 40 is severely deflected so as to cause a fracture in the weakened horizontal lower flange 32 along the trough 42. Once the fracture is started it continues in a controlled manner along the path of trough 42 until the entire vertical web 40 and part of the horizontal lower flange 32 are separated, leaving a "J" section for use on structural L-beam members, as illustrated in FIG. 6. A structural L-beam member 44 is secured with a nail 48 to a wall 46 as is encountered about the perimeter of most ceiling installations. Modified trim strip 33 resiliently engages lower flange 45 of the L-beam member 44 between upper and lower horizontal flanges 32 and 36 of modified trim strip 33.

As illustrated in FIG. 1, trim strips 30 terminate between the intersecting structural T-beam members because of the obstruction to upper horizontal flange 36 and the obstruction to both vertical flanges 34 and 40 at such intersections. The decorative trim strips could be routed at the intersections to provide access for the intersecting T-beam members. However, better results are obtained when the decorative trim strips 30 are cut short of each intersection to allow for expansion of the linear strips and when an intersection cap 50, as illustrated in FIG. 7, is provided to conceal the exposed structural T-beam members at the intersections left exposed by the shortened trim strips 30.

Figure 8:
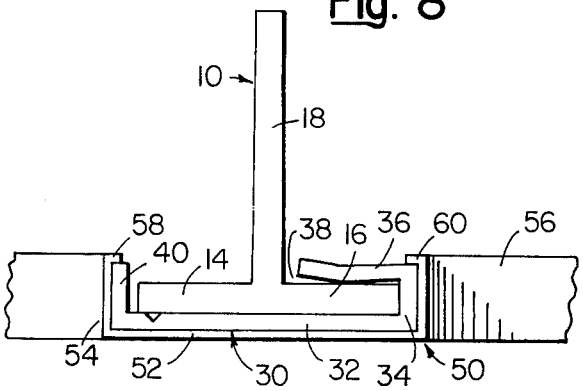
FIG. 8 is an end elevation illustrating the trim strip in supported and aligned position on a structural T-beam member and the intersection cap in supported and aligned position on the decorative trim strip.
Figure 7:
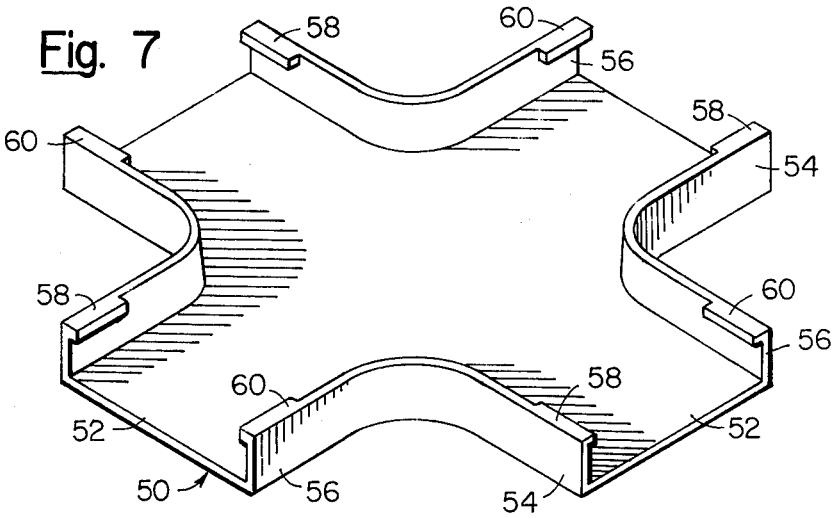
FIG. 7 is an enlarged isometric view of the decorative intersection cap unit as depicted in FIG. 1.

FIG. 7 illustrates the resilient decorative intersection cap 50 comprised of a cross or "X" shaped horizontal flange 52 having spaced apart vertically extending web portions 54 and 56, said web portions being provided with inwardly extending resilient protrusions 58 and 60 at the top ends of said webs, which extend over minor portions of the horizontal flange of the cap to engage decorative trim strip 30 at vertical web portions 34 and 40 thereof. As illustrated in FIG. 8, said decorative trim strip 30 is seated in the recess of the cap so as to engage both vertical sides thereof to maintain the intersection cap 50 in juxtaposition with said trim strip 30 and in juxtaposition with the structural T-beam member, partially covering the trim strip 30 and the exposed flanges 14 and 16 of the T-beam member 10 at each intersection.

It is apparent that within the scope of the invention modifications and arrangements may be made other than as herein disclosed. The present disclosure is merely illustrative, the invention comprehending all variations thereof.

We claim:

1. A resilient decorative trim strip for covering normally exposed lower surfaces of horizontal flanges of beams for supporting ceiling panels which comprises a horizontal lower flange, a substantially horizontal upper flange slightly less than half the width of the lower flange and a short vertical web connecting the horizontal flanges and forming a J-member with them, with the leg of the J being horizontal, with the end of the substantially horizontal upper flange away from the vertical web being angled upwardly therefrom to facilitate placement of the strip over a horizontal flange of the ceiling panel supporting beam and with the opening between the flanges of the strip being such size that the flanges of the strip contact the flange of the beam.

2. A decorative trim strip according to claim 1 which includes a vertical web at the opposite end of the horizontal lower flange from the vertical web of the J, which, with said J-member web and said horizontal lower flange, forms a channel of slightly greater width than a T-beam support for ceiling panels so as to restrict lateral movement of the trim with respect to the T-beam on which it is to be installed.

3. A decorative trim strip according to claim 2 which is weakened at a location near the vertical web opposite to the web of the J to facilitate the controlled separation of such opposite vertical web and convert the trim to a modified trim suitable for use in convering lower flanges of L-beams for supporting ceiling panels.

4. A decorative trim strip according to claim 3 wherein the weakening thereof is along a straight line on the upper surface of the horizontal lower flange parallel to the end thereof and near the vertical web opposite to the web of the J to facilitate the controlled separation from the trim strip of such opposite vertical web and an adjacent portion of the horizontal lower flange so that the remaining horizontal lower flange is of a length that covers the lower flange of the L-beam.

5. A resilient decorative trim strip for covering normally exposed lower surfaces of horizontal flanges of T-beams for supporting ceiling panels, which is convertible to a decorative trim strip for covering normally exposed lower surfaces of horizontal flanges of L-beams for supporting ceiling panels, which comprises a horizontal lower flange, a substantially horizontal upper flange slightly less than half the width of the lower flange, a short vertical web connecting the horizontal flanges and forming a J-member with them, with the leg of the J being horizontal and an opposing vertical web at the opposite end of the horizontal lower flange from the vertical web of the J-member, which, with such J-member web and horizontal lower flange, forms a channel of slightly greater width than the T-beam support for ceiling panels so as to restrict lateral movement of the strip with respect to the T-beam, which strip is weakened at a location near the vertical web opposite to the web of the J-member to facilitate the controlled separation of such opposite vertical web so as to convert the trim to a modified trim suitable for use in covering L-beam members for supporting ceiling panels.

6. A decorative trim strip according to claim 5 wherein the weakening thereof is along a straight line on the upper surface of the horizontal lower flange parallel to the end thereof and near the vertical web opposite to the web of the J to facilitate the controlled separation from the trim strip of such opposite vertical web and an adjacent portion of the horizontal lower flange so that the remaining horizontal lower flange is of a length that covers the lower flange of the L-beam.

7. A ceiling panel support assembly with beams thereof covered with thin, resilient decorative trim strips which comprises a plurality of T-beam supports for ceiling panels in cruciform relationship, with each of the T-beams having the normally exposed lower surface of its horizontal flange covered by a resilient decorative trim strip, each of which strips comprises a horizontal lower flange, a substantially horizontal upper flange slightly less than half the width of the lower flange, a short vertical web connecting the horizontal flanges and forming a J-member with them, with the leg of the J being horizontal, a vertical web at the opposite end of the horizontal lower flange from the vertical web of the J, which, with said J-member web and the horizontal lower flange forms a channel of slightly greater width than that of the T-beams, so as to restrict lateral movement of the trim with respect to the T-beam, with the end of the substantially horizontal upper flange away from the vertical web of the J being angled upwardly therefrom to facilitate installation of the strip over the T-beam, and with the opening between the flanges of the strip being of such size that the flanges of the strip contact the flange of the T-beam.

8. A ceiling panel support assembly according to claim 11 wherein the decorative trim strips, which terminate at the ends of the intersecting T-beams, are covered by a decorative resilient intersection cap comprised or a cruciform horizontal flange portion having vertically extending short web portions about the outside of the cap except at the ends of the cross and inwardly extending resilient protrusions at the top ends of said webs which extend over minor portions of the horizontal flange of the cap and engage upper portions of both sides of each of said trim strips to maintain the intersection cap in position on said strips at said intersections.

* * * * *